United States Patent [19]

Saito

[11] 4,424,689

[45] Jan. 10, 1984

[54] FINGER RING

[75] Inventor: Takashi Saito, Funabashi, Japan

[73] Assignee: Takashi Saito/Iwasaki Denko Company, Ltd., Tokyo, Japan

[21] Appl. No.: 297,020

[22] Filed: Aug. 27, 1981

[30] Foreign Application Priority Data

Sep. 1, 1980 [JP] Japan ..... 55-123126[U]

[51] Int. Cl.[3] ..... A44C 9/02

[52] U.S. Cl. ..... 63/15.1

[58] Field of Search ..... 63/15.1, 15.2, 15.3, 63/15.4, 15

[56] References Cited

U.S. PATENT DOCUMENTS

D. 64,849 6/1924 Granat ..... 63/15 UX
4,043,135 8/1977 Chervin ..... 63/15

FOREIGN PATENT DOCUMENTS 580602 8/1959 Canada ..... 63/15
608999 11/1960 Canada ..... 63/15
2357054 11/1973 Fed. Rep. of Germany ..... 63/15
759302 11/1933 France ..... 63/15.4

*Primary Examiner*—F. Barry Shay
*Attorney, Agent, or Firm*—Schwartz, Jeffery, Schwaab, Mack, Blumental & Koch

[57] ABSTRACT

A finger ring comprises first and second separate ring members, each of which has a hole into which the finger can be inserted, and is composed of a central inscribed circular main hole region whose diameter is substantially equal to the smaller diameter of the joint of the finger to be inserted into the ring member and a pair of segmental supplementary hole region extending from said central circular main hole region, and a pair of permanent magnets for connecting the first and second ring members fitted around the finger so that their relative movement along the finger is prevented when the first ring member is rotated through a prescribed angle.

7 Claims, 7 Drawing Figures

FINGER RING

BACKGROUND OF THE INVENTION

This invention relates to a finger ring adapted for use as an ornamental or health-preserving article.

The conventional finger ring has a circular hole or inner periphery. Difficulties sometimes arise in removing a ring from a finger, because the finger joints frictionally contact the inner periphery of the ring. In extreme cases, a ring can not be taken off a finger by any means, making it necessary to cut off the ring. Such event raises problems, particularly where the ring is expensive.

A ring customer being fitted for a ring inserts his or her fingers which is inserted into a ring measuring gauge and selects a ring whose inner diameter corresponds to the measured thickness of said finger. Where, however, a conventional ring having a circular hole which is bought by a user happens to have an improper gauge number, then the ring does not properly fit to the finger. In this case, the ring may be excessively tight on the finger, or, alternately, the ring may fit loosely around the finger, in which case the ring tends to move about the finger. Therefore, the conventional ring having a circular hole has the drawback that it is impossible to obtain a perfect fit within dimensional tolerance of the ring hole.

SUMMARY OF THE INVENTION

It is accordingly the object of this invention to provide a finger ring which is free from the above-mentioned drawbacks, can be easily put on or taken off the finger, and assures a sufficiently tight fit so as not to ready come off, and whose inner hole has a dimensional latitude.

BRIEF DESCRIPTION OF THE DRAWINGS

FIGS. 1 to 4 show a finger ring according to one embodiment of this invention, wherein FIG. 1 is a sectional view, FIG. 2 is a view indicating the shape of the ring hole, FIG. 3 is an oblique view of a ring in the process of being fitted to the finger, and FIG. 4 is an oblique view of a ring fitted to the finger;

DETAILED DESCRIPTION OF THE PREFERRED EMBODIMENTS

Description is now given with reference to the accompanying drawings of a finger ring according to one embodiment of this invention.

Figure 1:
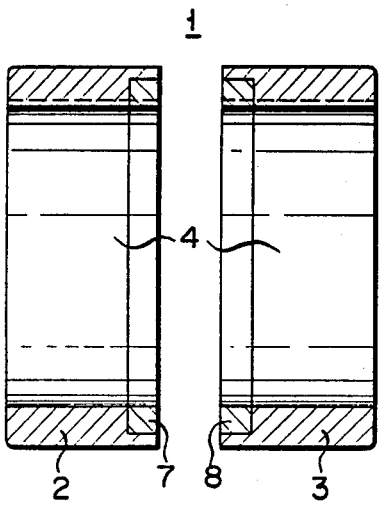
Figure 2:
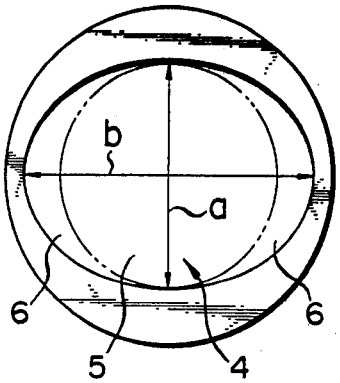

A finger ring 1 of FIG. 1 comprises first and second separate ring members or components 2, 3. These ring members 2, 3 are prepared with the same shape from precious metals such as gold, silver or platinum for an ornamental purpose and from permanent magnets for a health-preserving purpose. As seen from FIG. 2, each ring member has an elliptic hole 4, and a circular outer appearance. The elliptic hole 4 is defined by a central inscribed circular region 5 and a pair of segmental regions 6 projecting from opposite sides of said circular region 5. The diameter of the central circular region 5, that is, the shorter diameter a of the ellipsis is chosen to have substantially the same measurement as the height of the joint of the finger fitted into the ring (that is, the shorter diameter of said joint). On the other hand, the longer diameter b of the ellipsis defined by the central circular region 5 and both adjacent segmental regions 6 is chosen to have the same measurement as the width of the joint of the finger fitted into the ring (that is, the longer diameter of said joint). The circular region 5 constitutes the main hole portion, and both segmental regions 6 constitute the supplementary hole portions.

Both ring members or components 2, 3 comprise means which are set on the mutually facing sides of said ring members 2, 3 to connect them together and restrict their relative axial movement.

These securing means are formed of permanent magnets 7, 8 respectively embedded in the adjacent end faces 2*a*, 3*a* of the ring members 2, 3. Alternatively, one of the securing means may be a member having a hole and the other may be a projection which is snapped into the hole. Further, they may be fitting devices such as retainers or hooks, which are provided on the lower portions of the mountings of the ring members 2 and 3.

Figure 3:
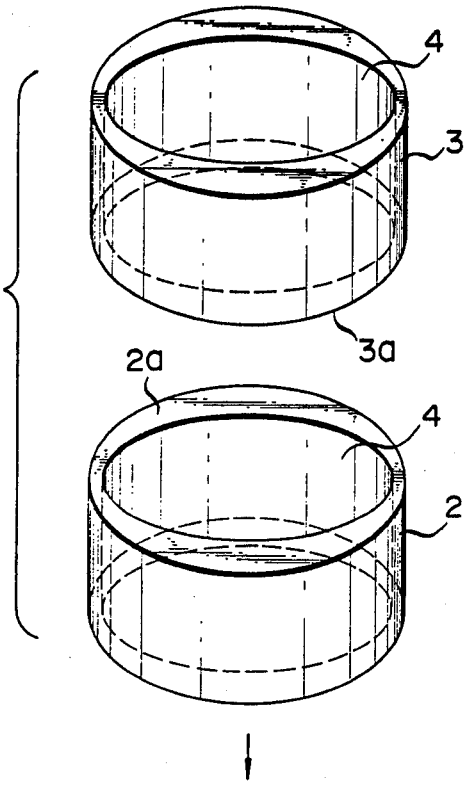
Figure 4:
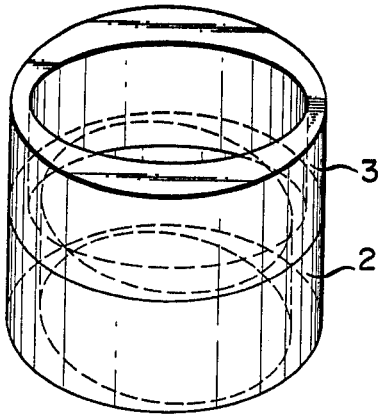

Description is now given with reference to FIGS. 3 and 4 of the method of fitting the ring constructed as described above to the finger and taking said ring off the finger. The first ring member 2 is moved in a direction indicated by an arrow in FIG. 3, while the end face 2*a* on which a permanent magnet 7 is provided is kept at the top. At this time, the first ring member is fitted around the finger in such a manner that an accord is attained between the longer diameter of the finger joint and that of the ring hole 4, as well as between the shorter diameter of the finger joint and that of the ring hole 4. This process enables the ring to be smoothly fitted around the finger. Similarly, the second ring member 3 is fitted around the finger while the end face 3*a* on which a permanent magnet 8 is provided is kept at the bottom. As in the case of the first ring member, the second ring member is fitted around the finger in such a manner that an accord is attained between the longer diameter of the finger joint and that of the ring hole 4, as well as between the shorter diameter of the finger joint and that of the ring hole 4. After fitted around the finger the second ring member 3 is rotated through a prescribed angle about its axis to be connected to the first ring member 2 to constitute an integral ring, with the mutually facing permanent magnets 7, 8 (FIG. 1) interposed therebetween. As shown in FIG. 4, therefore, the elliptic holes 4 of the first and second ring members 2, 3 are displaced from each other through a prescribed angle. As a result, the effective hole area of the finger ring is equal to that occupied by the superpose sections of both elliptic holes 4. As seen from FIG. 2, therefore, the total area of both adjacent segmental regions 6 is smaller than the central circular open region 5, thereby preventing the composite ring from coming off the finger joint.

Where the composite ring is taken off, the mutual engagement of the first and second ring members 2, 3 by the permanent magnets 7, 8 is released, causing the second ring member 3 to be rotated back to the position at which said second ring member 3 began to be fitted around the finger. At this time, the elliptic holes 4 of the first and second ring members 2, 3 are aligned with each other, and consequently the resultant free space substantially accords with the sectional shape of the finger joint, thereby assuring the easy removal of the composite ring.

Figure 5:
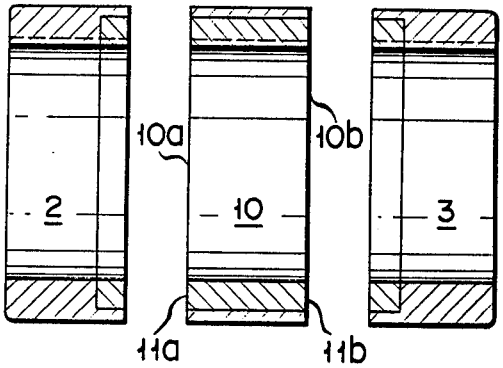
FIG. 5 is a sectional view of a finger ring according to one modification of FIGS. 1 to 4.

With the foregoing embodiment, a finger ring was formed of two ring members or components. However, the finger ring need not be limited to this arrangement. The point is that the finger ring be formed of a plurality of finger members. For instance, the finger ring may be composed of three ring members shown in FIG. 5. In this case, a third ring member 10 interposed between the first and second ring members 2, 3 should be provided with a pair of engagement members 11*a*, 11*b* at opposite end faces 10*a*, 10*b*. With the embodiment of FIG. 5, the engagement members 11*a*, 11*b* are respectively formed of a permanent magnet, but may be prepared from any other material. Where three ring members constituting a composite ring are separately fited around the finger, and later one or two of the three ring members are rotated through a prescribed angle, then the composite ring can be prevented from coming off the finger.

With the foregoing embodiment, each ring member was provided with an elliptic hole. However, the hole may take any other shape than a true circle. For instance, the hole may take a polygonal or any other somewhat ornamental shape or the hole of the first ring member may have a different shape than that of the second ring member.

Figure 6:
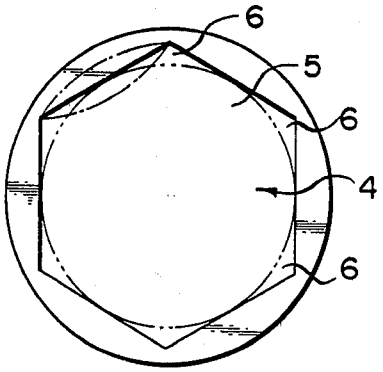
FIGS. 6 and 7 are plan views of ring members or components according to other modifications of FIGS. 1 to 4.
Figure 7:
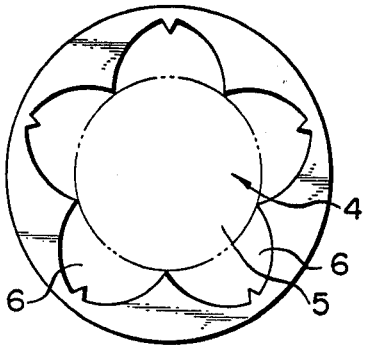

FIGS. 6 and 7 illustrate ring members whose holes have different shapes. The hole 4 of the ring member of FIG. 6 has a regular hexagonal shape. The hole 4 is comprised of a central inscribed central main hole region 5 and six supplementary hole regions projecting from the central circular main hole region 5 in the substantial triangular form. As indicated by chain line, at least one portion of the inner periphery of the ring member may be bulking or receding. With the ring member of FIG. 7, the hole 4 has a pattern shape such as a cherry blossom. This hole 4 is formed of a central circular main region 5 and five supplementary hole regions projecting from the central circular main hole in the form of a petal.

With the ring members illustrated in FIGS. 6 and 7, too, the fitting of a ring around the finger or the removal of the ring therefrom is easily effected by utilizing the supplementary hole regions 6. Where the ring members are engaged with each other by relative rotation, then the composite ring is prevented from coming off the finger.

With the foregoing embodiment, a permanent magnet was applied as means for connecting or engaging the ring members with each other. However, this invention is not limited to this arrangement. The means for engaging the ring members with each other well serve the purpose, provided it prevents the relative movement of the ring members in the direction in which the finger projects from its base.

What is claimed is:

1. A finger ring which comprises:

a first ring member which has a non-circular hole being composed of a central inscribed circular main hole region whose diameter is substantially equal to the smaller diameter of the joint of the finger to be inserted into the ring member, and at least one supplementary hole region extending from said central circular main hole region;

a second, separate ring member which has a non-circular hole into which the finger can be inserted, said hole being composed of a central inscribed circular main hole region whose diameter is substantially equal to the smaller diameter of the joint of the finger to be inserted into the ring member, and at least one supplementary hole region extending from said central circular main hole region;

said first and second ring members insertable on said finger independently and separately from one another; and means for connecting the first and second ring members after they have been individually placed around the finger so that their relative movement along the finger lengthwise thereof is prevented, while permitting one of said ring members to be rotated relative to the other ring member through a prescribed angle.

2. The finger ring according to claim 1, wherein the hole of the first ring member has the same shape as that of the second ring member.

3. The finger ring according to claim 2, wherein the holes of the first and second ring members have the same elliptic shape.

4. The finger ring according to claim 2, wherein the holes of the first and second ring members have a polygonal shape.

5. The finger ring according to claim 4, wherein the holes of the first and second ring members have a hexagonal shape.

6. The finger ring according to claim 1, wherein the hole of the first ring member has a different shape from that of the second ring member.

7. The finger ring according to any of claims 1 to 3, wherein the first and second ring members are connected together by means of permanent magnets provided on the adjacent and faces of said ring members.

* * * * *